US006567781B1

(12) United States Patent
Lafe

(10) Patent No.: US 6,567,781 B1
(45) Date of Patent: May 20, 2003

(54) METHOD AND APPARATUS FOR COMPRESSING AUDIO DATA USING A DYNAMICAL SYSTEM HAVING A MULTI-STATE DYNAMICAL RULE SET AND ASSOCIATED TRANSFORM BASIS FUNCTION

(75) Inventor: Olurinde E. Lafe, Chesterland, OH (US)

(73) Assignee: QuikCAT.com, Inc., Mayfield Village, OH (US)

( * ) Notice: Subject to any disclaimer, the term of this patent is extended or adjusted under 35 U.S.C. 154(b) by 0 days.

(21) Appl. No.: 09/518,357

(22) Filed: Mar. 3, 2000

Related U.S. Application Data

(60) Provisional application No. 60/174,060, filed on Dec. 30, 1999.

(51) Int. Cl.[7] ..... G10L 19/00
(52) U.S. Cl. ..... 704/500; 704/501
(58) Field of Search ..... 704/500, 200.1

(56) References Cited

U.S. PATENT DOCUMENTS

| | | | | |
|---|---|---|---|---|
| 4,769,644 A | * | 9/1988 | Frazier | 340/14.61 |
| 4,866,636 A | | 9/1989 | Fukami et al. | 364/514 |
| 5,109,417 A | | 4/1992 | Fielder et al. | 381/36 |

(List continued on next page.)

FOREIGN PATENT DOCUMENTS

WO 97/12330 4/1997

OTHER PUBLICATIONS

Y. Mahieux, et al.; "Transform Coding of Audio Signals at 64 Kbit/s"; 1990 IEEE; pp. 518–522.

M. Wada, et al.; "Possibility of Digital Data Description by Means of Rule Dynamics in Cellular Automata"; 1999 IEEE; pp. 278–283.

M. Goodwin, et al.; "Automic Decompositions of Audio Signals"; XP–002161889.

P. J. Hahn, et al.; "Perceptually Lossless Image Compression"; XP–002163214.

A. Aggarwal, et al.; "Perceptual Zerotrees for Scalable Wavelet Coding of Wideband Audio"; XP002163214.

EP International Search Report mailed Mar. 3, 2001.

*Primary Examiner*—Doris H. To
*Assistant Examiner*—Michael N. Opsasnick
(74) *Attorney, Agent, or Firm*—Mark Kusner; Michael A. Jaffe

(57) ABSTRACT

Digital audio is transformed using a set of filters derived from the evolving states of a dynamical system (e.g., cellular automata). The ensuing transform coefficients are quantized using a psycho-acoustic model that is a function of a fidelity parameter and the distribution of the transform coefficients in critical bands within the transform space. The technique results in compression of the original audio data. Recovery of a close approximation of the original audio data is obtained via a rapid inverse transformation. An encoding method is provided for accelerating the transmission of audio data through communications networks and storing the data on a digital storage media.

39 Claims, 5 Drawing Sheets

U.S. PATENT DOCUMENTS 5,321,776 A 6/1994 Shapiro ..... 382/56
5,388,181 A 2/1995 Anderson et al. ..... 395/212
5,412,741 A 5/1995 Shapiro ..... 382/232
5,479,562 A 12/1995 Fielder et al. ..... 395/2.38
5,481,614 A 1/1996 Johnston ..... 381/2
5,511,146 A * 4/1996 Simar, Jr. ..... 706/10
5,548,574 A 8/1996 Shimoyoshi et al. ..... 369/124
5,570,305 A 10/1996 Fattouche et al. ..... 364/15.02
5,590,108 A 12/1996 Mitsuno et al. ..... 369/59
5,611,038 A 3/1997 Shaw et al. ..... 395/806
5,632,003 A 5/1997 Davidson et al. ..... 395/2.38
5,677,956 A * 10/1997 Lafe ..... 380/263
5,680,462 A * 10/1997 Miller et al. ..... 380/263
5,699,484 A 12/1997 Davis ..... 345/2.28
5,761,636 A 6/1998 Bolton et al. ..... 704/229
5,764,698 A 6/1998 Sudharsanan et al. ..... 375/241
5,781,888 A 7/1998 Herre ..... 704/219
5,819,215 A 10/1998 Dobson et al. ..... 704/230
6,006,179 A * 12/1999 Wu et al. ..... 704/205
6,363,350 B1 * 3/2002 Lafe ..... 704/201
6,393,154 B1 5/2002 Lafe ..... 382/239
6,400,766 B1 6/2002 Lafe ..... 375/240.21
6,456,744 B1 9/2002 Lafe ..... 382/248

* cited by examiner

METHOD AND APPARATUS FOR COMPRESSING AUDIO DATA USING A DYNAMICAL SYSTEM HAVING A MULTI-STATE DYNAMICAL RULE SET AND ASSOCIATED TRANSFORM BASIS FUNCTION

RELATED APPLICATIONS

The present application claims the benefit of U.S. Provisional Application No. 60/174,060 filed Dec. 30, 1999.

FIELD OF INVENTION

The present invention generally relates to the field of audio compression, and more particularly to a method and apparatus for audio compression which operates on dynamical systems, such as cellular automata (CA).

BACKGROUND OF THE INVENTION

The need frequently arises to transmit digital audio data across communications networks (e.g., the Internet; the Plain Old Telephone System, POTS; Local Area Networks, LAN; Wide Area Networks, WAN; Satellite Communications Systems). Many applications also require digital audio data to be stored on electronic devices such as magnetic media, optical disks and flash memories. The volume of data required to encode raw audio data is large. Consider a stereo audio data sampled at 44100 samples per second and with a maximum of 16 bits used to encode each sample per channel. A one-hour recording of a raw digital stereo music with that fidelity will occupy about 606 Megabytes of storage space. To transmit such an audio file over a 56 kilobits per second communications channel (e.g., the rate supported by most POTS through modems), will take over 24.6 hours.

The best approach for dealing with the bandwidth limitation and also reduce huge storage requirement is to compress the audio data. The most popular technique for compressing audio data combines transform approaches (e.g. the Discrete Cosine Transform, DCT) with psycho-acoustic techniques. The current industry standard is the so-called MP3 format (or MPEG audio developed by the International Standards Organization International Electrochemical Committee, ISO/IEC) which uses the aforementioned approach. Various enhancements to the standard have been proposed. For example, Bolton and Fiocca, in U.S. Pat. No. 5,761,636, taught a method for improving the audio compression system by a bit allocation scheme that favors certain frequency subband. Davis, in U.S. Pat. No. 5,699,484, taught a split-band perceptual coding system that makes use of predictive coding in frequency bands.

Other audio compression inventions that are based on variations of the traditional DCT transform and/or some bit allocation schemes (utilizing perceptual models) include those taught by Mitsuno et al. (U.S. Pat. No. 5,590,108), Shimoyoshi et al (U.S. Pat. No. 5,548,574), Johnston (U.S. Pat. No. 5,481,614), Fielder and Davidson (U.S. Pat. No. 5,109,417), Dobson et al. (U.S. Pat. No. 5,819,215), Davidson et al. (U.S. Pat. No. 5,632,003), Anderson et al. (U.S. Pat. No. 5,388,181), Sudharsanan et al. (U.S. Pat. No. 5,764,698) and Herre (U.S. Pat. No. 5,781,888).

Some recent inventions (e.g., Dobson et al. in U.S. Pat. No. 5,819,215) teach the use of the wavelet transform as the tool for audio compression. The bit allocation schemes on the wavelet-based compression methods are generally based on the so-called embedded zero-tree concept taught by Shapiro (U.S. Pat. Nos. 5,321,776 and 5,412,741). Other audio compression schemes that utilize wavelets as basis functions are described in the paper by Painter & Spanias (1999) and they include the work by Tewik et al (1993a,b,c); Black & Zeytinoglu (1995); Kudumakis and Sandler (1995a, b); and Boland & Deriche (1995,1996).

In order to achieve a better compression of digital audio data, the present. invention makes use of a transform method that uses dynamical systems. In accordance with a preferred embodiment, the evolving fields of cellular automata are used to generate building blocks for audio data. The rules governing the evolution of the dynamical system can be adjusted to produce building blocks that satisfy the requirements of low-bit rate audio compression process.

The concept of cellular automata transform (CAT) is taught in U.S. Pat. No. 5,677,956 by Lafe, as an apparatus for encrypting and decrypting data. The present invention teaches the use of more complex dynamical systems that produce efficient building blocks for encoding audio data. The present invention also teaches a psycho-acoustic method developed specially for the sub-band encoding process arising from the cellular automata transform. A special bit allocation scheme that also facilitates audio streaming is taught as an efficient means for encoding the quantized transform coefficients obtained after the cellular automata transform process.

SUMMARY OF THE INVENTION

According to the present invention there is provided a method of compressing audio data comprising: determining a multi-state dynamical rule set and an associated transform basis function, receiving input audio data, and performing a forward transform using the transform basis function to obtain transform coefficients suitable for reconstructing the input audio data.

An advantage of the present invention is the provision of a method and apparatus for audio compression which provides improvements in the efficiency of digital media storage.

Another advantage of the present invention is the provision of a method and apparatus for audio compression which provides faster data transmission through communication channels.

Still another advantage of the present invention is the provision of a method and apparatus for audio compression which utilizes psycho-acoustics.

Yet another advantage of the present invention is the provision of a method and apparatus for audio compression which facilitates audio streaming.

Still other advantages of the invention will become apparent to those skilled in the art upon a reading and understanding of the following detailed description, accompanying drawings and appended claims.

DETAILED DESCRIPTION OF THE INVENTION

It should be appreciated that while a preferred embodiment of the present invention will be described with reference to cellular automata as the dynamical system, other dynamical systems are also suitable for use in connection with the present invention, such as neural networks and systolic arrays.

In summary, the present invention teaches the use of a transform basis function (also referred to herein as a "filter") to transform audio data for the purpose of more efficient storage on digital media or faster transmission through communications channels. The transform basis function is comprised of a plurality of "building blocks," also referred to herein as "elements" or "transform bases." According to a preferred embodiment of the present invention, the elements of the transform basis function are obtained from the evolving field of cellular automata. The rules of evolution are selected to favor those that result in an "orthogonal" transform basis function. A special psycho-acoustic model is utilized to quantize the ensuing transform coefficients. The quantized transform coefficients are preferably stored/transmitted using a hybrid run-length-based/Huffman/embedded stream coder. The encoding technique of the present invention allows sequences of audio data to be streamed continuously across communication networks.

Figure 1:
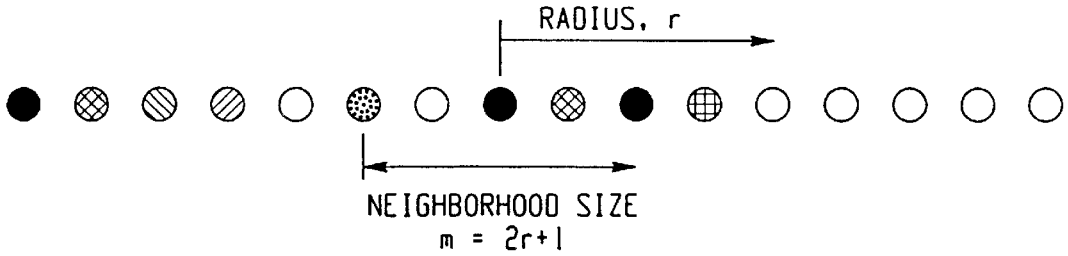
FIG. 1 illustrates a one-dimensional multi-state dynamical system.

Referring now to the drawings wherein the showings are for the purposes of illustrating a preferred embodiment of the invention only and not for purposes of limiting same, FIG. 1 illustrates a one-dimensional multi-state dynamical system. Cellular Automata (CA) are dynamical systems in which space and time are discrete. The cells are arranged in the form of a regular lattice structure and must each have a finite number of states. These states are updated synchronously according to a specified local rule of interaction. For example, a simple 2-state 1-dimensional cellular automaton will consist of a line of cells/sites, each of which can take value 0 or 1. Using a specified rule (usually deterministic), the values are updated synchronously in discrete time steps for all cells. With a K-state automaton, each cell can take any of the integer values between 0 and K−1. In general, the rule governing the evolution of the cellular automaton will encompass m sites up to a finite distance r away. Accordingly, the cellular automaton is referred to as a K-state, m-site neighborhood CA.

The number of dynamical system rules available for a given encryption problem can be astronomical even for a modest lattice space, neighborhood size, and CA state. Therefore, in order to develop practical applications, a system must be developed for addressing the pertinent CA rules. Consider, for an example, a K-state N-node cellular automaton with m=2r+1 points per neighborhood. Hence in each neighborhood, if a numbering system is chosen that is localized to each neighborhood, then the following represents the states of the cells at time t: $a_{it}$ (i=0,1,2,3, . . . m−1). The rule of evolution of a cellular automaton is defined by using a vector of integers $W_j$ (j=0,1,2,3, . . . ,$2^m$) such that $$a_{(r)(t+1)} = \left(\sum_{j=0}^{2^m-2} W_j\alpha_j + W_{2^m-1}\right)^{W_{2^m}} \bmod K \tag{1}$$

where $0 \leqq W_j < K$ and $\alpha_j$ are made up of the permutations (and products) of the states of the cells in the neighborhood. To illustrate these permutations consider a 3-neighborhood one-dimensional CA. Since m=3, there are $2^3$=8 integer W values. The states of the cells are (from left-to-right) $a_{0t}$,$a_{1t}$, $a_{2t}$ at time t. The state of the middle cell at time t+1 is:

$$a_{1(t+1)}=(W_0a_{0t}+W_1a_{1t}+W_2a_{2t}+W_3a_{0t}a_{1t}+W_4a_{1t}a_{2t}+W_5a_{2t}a_{0t}+W_6a_{0t}a_{1t}a_{2t}+W_7)^{W_8} \bmod K \tag{2}$$

Hence each set of $W_j$ results in a given rule of evolution. The chief advantage of the above rule-numbering scheme is that the number of integers is a function of the neighborhood size; it is independent of the maximum state, K, and the shape/size of the lattice.

Set forth below is an exemplary C code for evolving one-dimensional cellular automata using a reduced set ($W^{2m}$=1) of the W-class rule system, where vector {a} represents the states of the cells in the neighborhood and RuleSize=$2^{NeighborhoodSize}$.

```
int EvolveCellularAutomata(int *a)
{
    int i,j,seed,p,D=0,Nz=NeighborhoodSize-1,Residual;
    for (i=0;i<RuleSize;i++)
    {
        seed=1;p=1 << Nz;Residual=i;
        for j=Nz;j>=0;j--)
        {
            if(Residual >= p)
            {
                seed *= s[j];
                Residual -= p;
            }
            if(seed == 0) break;
            p >>= 1;
        }
        D += (seed*W[i]);
    }
    return (D % STATE);
}
```

Given a data f in a D dimensional space measured by the independent discrete variable i, we seek a transformation in the form:

$$f_i = \sum_k c_k A_{ik} \tag{3}$$

where $A_{ik}$ are cellular automata transform bases, k is a vector (defined in D) of non-negative integers, while $c_k$ are transform coefficients whose values are obtained from the inverse transform:

$$c_k = \sum_k f_i B_{ik} \tag{4}$$

in which the transform basis function B is the inverse of transform basis function A.

When the transform bases A are orthogonal, the number of transform coefficients is equal to that in the original data f. Furthermore, orthogonal transformation offers considerable simplicity in the calculation of the transform coefficients. From the point-of-view of general digital signal processing applications, orthogonal transforms are preferable on account of their computational efficiency and elegance. The forward and inverse transform basis functions A and B are generated from the evolving states a of the cellular automata. Described below is a general description of how the transform basis functions are generated.

A given CA transform is characterized by one (or a combination) of the following features:

(a) The method used in calculating the bases from the evolving states of cellular automata.

(b) The orthogonality or non-orthogonality of the transform basis functions.

(c) The method used in calculating the transform coefficients (orthogonal transformation is the easiest).

The simplest transform bases are those with transform coefficients (1,−1) and are usually derived from dual-state cellular automata. Some transform bases are generated from the instantaneous point density of the evolving field of the cellular automata. Other transform basis functions are generated from a multiple-cell-averaged density of the evolving automata.

One-dimensional (D≡1) cellular spaces offer the simplest environment for generating CA transform bases. They offer several advantages, including:

(a) A manageable alphabet base for small neighborhood size, m, and maximum state K. This is a strong advantage in data compression applications.

(b) The possibility of generating higher-dimensional bases from combinations of the one-dimensional.

(c) The excellent knowledge base of one-dimensional cellular automata.

In a 1D space our goal is to generate the transform basis function $$A=A_{ik}\ i,k=0,1,2,\ldots N-1$$

from a field of L cells evolved for T time steps. Therefore consider the data sequence $f_i$(i=0,1,2, . . . N−1), where:

$$f_i=\sum_{k=0}^{N-1} c_k A_{ik}\quad i,k=0,1,2,\ldots N-1 \tag{5}$$

in which $c_k$ are the transform coefficients. There are infinite ways by which $A_{ik}$ can be expressed as a function of the evolving field of the cellular automata $a\equiv a_{it}$, (i=0, 1, 2, . . . L−1; t=0, 1, 2, . . . T−1). A few of these are enumerated below.

Figure 2:
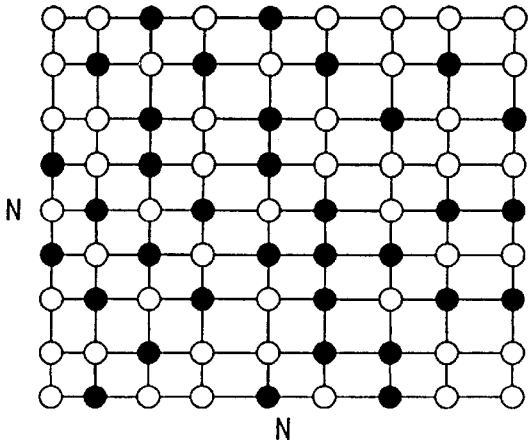
FIG. 2 illustrates the layout of a cellular automata lattice space for a Class I Scheme.

Referring now to FIG. 2, the simplest way of generating the transform bases is to evolve N cells over N time steps. That is L=T=N. This results in $N^2$ transform coefficients from which the transform bases (i.e., "building blocks") $A_{ik}$ can be derived. This is referred to as the Class I Scheme. It should be noted that the bottom base states shown in FIG. 2 form the initial configuration of the cellular automata.

Figure 3:
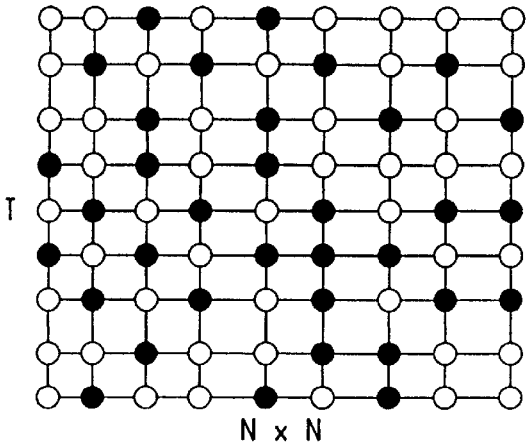
FIG. 3 illustrates the layout of a cellular automata lattice space for a Class II Scheme.

Referring now to FIG. 3, a more universal approach known as the Class II Scheme is shown. In the Class II Scheme $L=N^2$ (i.e., the number of transform coefficients to be derived) and the evolution time T is independent of the number of elements forming the transform basis function. One major advantage of the latter approach is the flexibility to tie the transform bases precision to the evolution time T. It should be noted that the bottom base states shown in FIG. 3 form the initial configuration of the cellular automata.

Class I Scheme

When the N cells are evolved over N times steps, we obtain $N^2$ integers $$a\equiv a_{it},\ (i,t=0,1,2,\ldots N-1)$$

which are the states of the cellular automata including the initial configuration. A few bases types belonging to this group include:

Type 1

$$A_{ik}=\alpha+\beta a_{ik}$$

where $a_{ik}$ is the state of the CA at the node i at time t=k while α and β are constants.

Type 2

$$A_{ik}=\alpha+\beta a_{ik}a_{ki}$$

Class II Scheme

Two types of transform basis functions are showcased under this scheme:

Type 1:

$$A_{ik}=\alpha+\beta\sum_{t=0}^{T-1} a_{(k+iN)(T-1-t)}/K^t$$

in which K is the maximum state of the automation.

Type 2:

$$A_{ik}=\sum_{t=0}^{T-1}\{a_{(k+iN)(T-1-t)}-\beta\}$$

In most applications it is desirable to have transform basis functions which are orthogonal. Accordingly, the transform bases $A_{ik}$ should satisfy:

$$\sum_{i=0}^{N-1} A_{ik}A_{il}=\begin{cases}\lambda_k & k=l\\ 0 & k\neq l\end{cases} \tag{6}$$

where $\lambda_k$ (k=0,1, . . . N−1) are coefficients. The transform coefficients are easily computed as:

$$c_k=\frac{1}{\lambda_k}\sum_{i=0}^{N-1} f_i A_{ik} \tag{7}$$

That is, the inverse transform bases are:

$$B_{ik}=\frac{A_{ik}}{\lambda_k} \tag{8}$$

A limited set of orthogonal CA transform bases are symmetric: $A_{ik}=A_{ki}$. The symmetry property can be exploited in accelerating the CA transform process.

It should be appreciated that the transform basis functions calculated from the CA states will generally not be orthogonal. There are simple normalization/scaling schemes that can be utilized to make these orthogonal and also satisfy other conditions (e.g., smoothness of reconstructed data) that may be required for a given problem.

Figure 5A:
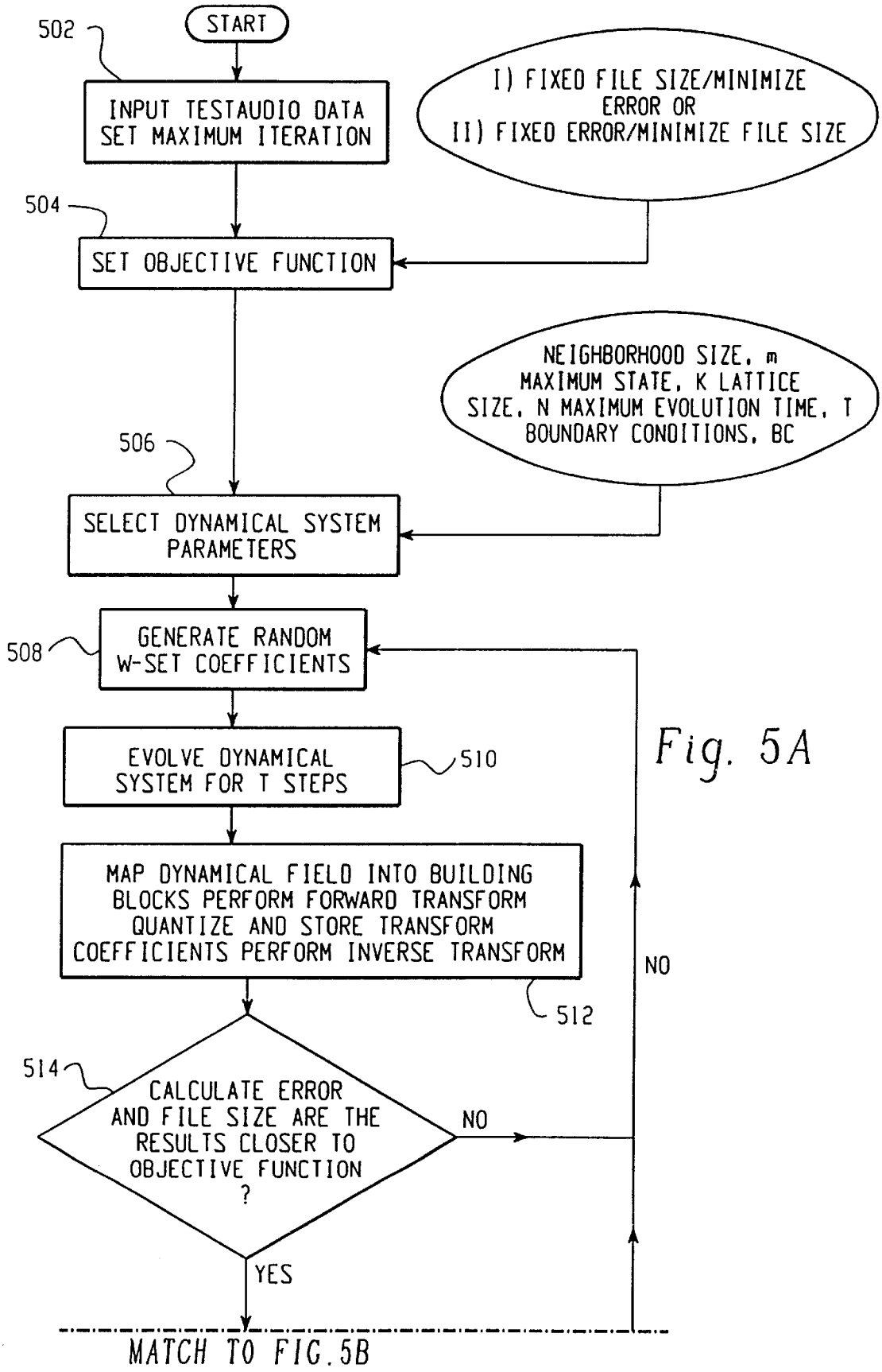
FIG. 5 is a flow chart illustrating the steps involved in generating efficient audio data building blocks, according to a preferred embodiment of the present invention.
Figure 5B:
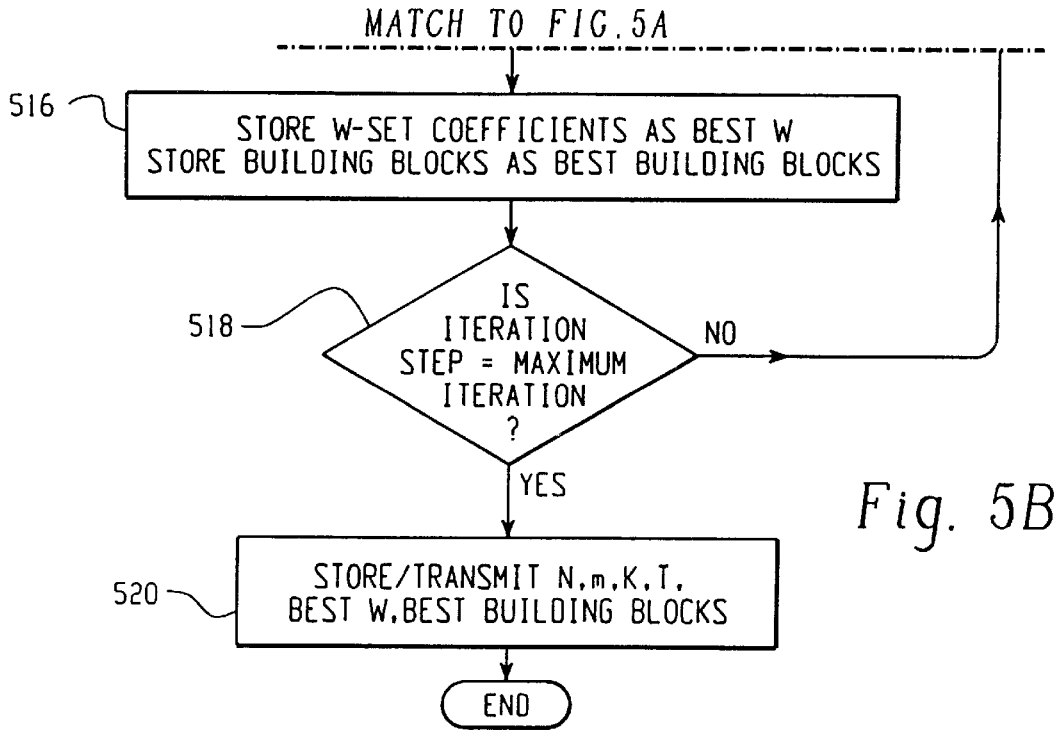

Referring now to FIG. 5, there is shown a flow chart illustrating the steps involved in generating an efficient transform basis function (comprised of "building blocks"), according to a preferred embodiment of the present invention. At step 502, Test Audio data is input into a dynamical system as the initial configuration of the automaton, and a maximum iteration is selected. Next, an objective function is determined, namely fixed file size/minimize error or fixed error/minimize file size (step 504). At steps 506 and 508, parameters of a dynamical system rule set (also referred to herein as "gateway keys") are selected. Typical rule set parameters include CA rule of interaction, maximum number of states per cell, number of cells per neighborhood, number of cells in the lattice, initial configuration of the cells, boundary configuration, geometric structure of the CA space (e.g., one-dimensional, square and hexagonal), dimensionality of the CA space, type of the CA transform (e.g., standard orthogonal, progressive orthogonal, non-orthogonal and self-generating), and type of the CA transform basis functions. For purposes of illustrating a preferred embodiment of the present invention, the rule set includes:

a) Size, m, of the neighborhood (e.g., one-divisional, square and hexagonal).

b) Maximum state K of the dynamical system.

c) The length N of the cellular automaton lattice space ("lattice size").

d) The maximum number of time steps T, for evolving the dynamical system.

e) Boundary conditions (BC) to be imposed. It will be appreciated that the dynamical system is a finite system, and therefore has extremities (i.e., end points). Thus, the nodes of the dynamical system in proximity to the boundaries must be dealt with. One approach is to create artificial neighbors for the "end point" nodes, and impose a state thereupon. Another common approach is to apply cyclic conditions that are imposed on both "end point" boundaries. Accordingly, the last data point is an immediate neighbor of the first. In many cases, the boundary conditions are fixed. Those skilled in the art will understand other suitable variations of the boundary conditions.

f) W-set coefficients $W_j$ (j=0,1,2, . . . $2^m$) for evolving the automaton.

The dynamical system is then evolved for T time steps in accordance with the rule set parameters (step 510). The resulting dynamical field is mapped into the transform bases (i.e., "building blocks"), a forward transform is performed to obtain transform coefficients. The resulting transform coefficients are quantized to eliminate insignificant transform coefficients (and/or to scale transform coefficients), and the quantized transform coefficients are stored. Then, an inverse transform is performed to reconstruct the original test data (using the transform bases and transform coefficients) in a decoding process (step 512). The error size and file size are calculated to determine whether the resulting error size and file size are closer to the selected objective function than any previously obtained results (step 514). If not, then new W-set coefficients are selected. Alternatively, one or more of the other dynamical system parameters may be modified in addition to, or instead of, the W-set coefficients (return to step 508). If the resulting error size and file size are closer to the selected objective function than any previously obtained results, then store the coefficient set W as BestW and store the transform bases as Best Building Blocks (step 516). Continue with steps 508–518 until the number of iterations exceeds the selected maximum iteration (step 518). Thereafter, store and/or transmit N, m, K, T, BC and BestW, and Best Building Blocks (step 520). One or more of these values will then be used to compress/decompress actual audio data, as will be described in detail below.

It should be appreciated that the initial configuration of the dynamical system, or the resulting dynamical field (after evolution for T time steps) may be stored/transmitted instead of the Best Building Blocks (i.e., transform bases). This may be preferred where use of storage space is to be minimized. In this case, further processing will be necessary in the encoding process to derive the building blocks (i.e., transform bases).

It should be understood that the CA filter (i.e., transform basis function) can be applied to input data in a non-overlapping or overlapping manner, when deriving the transform coefficients. The tacit assumption in the above derivations is that the CA filters are applied in a non-overlapping manner. Hence given a data, f, of length L, the filter A of size N×N is applied in the form:

$$f_i = \sum_{k=0}^{N-1} c_{kj} A_{(i \bmod N)k} \tag{9}$$

where i=0,1,2, . . . L−1 and j=0,1,2, . . . (L/N)−1 is a counter for the non-overlapping segments. The transform coefficients for points belonging to a particular segment are obtained solely from data points belonging to that segment.

As indicated above, CA filters can also be evolved as overlapping filters. In this case, if $l=N-N_l$ is the overlap, then the transform equation will be in the form:

$$f_i = \sum_{k=0}^{N-1} c_{kj} A_{(i \bmod N_l)k} \tag{10}$$

where i=0,1,2, . . . L−1 and j=0,1,2, . . . $(L/N_l)-1$ is the counter for overlapping segments. The condition at the end of the segment when i>L−N is handled by either zero padding or the usual assumption that the data is cyclic. Overlapped filters allow the natural connectivity that exists in a given data to be preserved through the transform process. Overlapping filters generally produce smooth reconstructed signals even after a heavy decimation of a large number of the transform coefficients. This property is important in the compression of audio data, digital images, and video signals.

Figure 6:
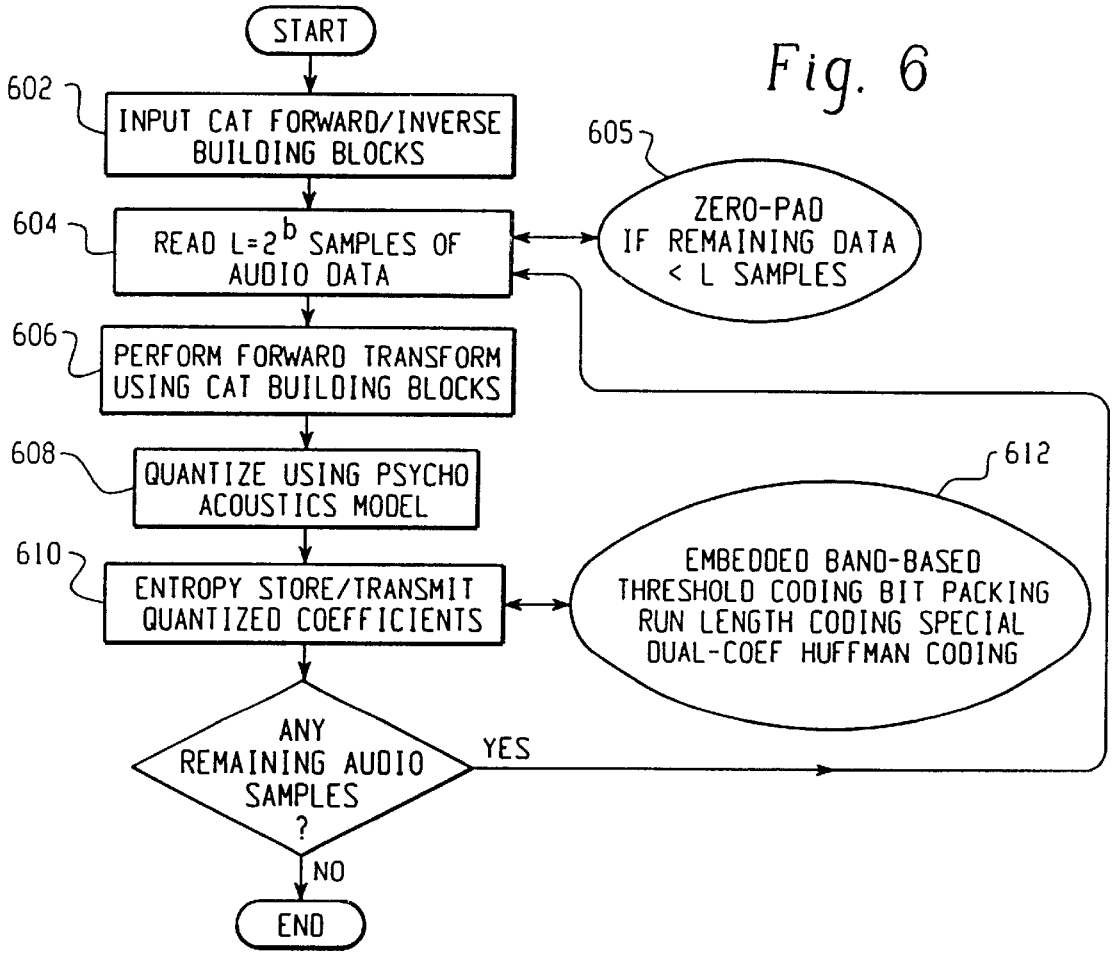
FIG. 6 is a flow diagram illustrating an encoding, quantization, and embedded stream processes, according to a preferred embodiment of the present invention.

Referring now to FIG. 6, a summary of the process for encoding input audio data will be described. The building blocks comprising a transform basis function are received (step 602). These building blocks are determined in accordance with the procedure described in connection with FIG. 5. Audio data to be compressed is input (step 604). Preferably, $L=2^b$ samples of audio data are read. If remaining audio data is less than L samples, then zero pad (step 605). Using the transform bases, a forward transform (as described above) is performed to obtain transform coefficients (step 606). It should be appreciated that this step may optionally include performing a "sub-band" forward transform, as will be explained below. As indicated above, given a data sequence $f_i$, the CA transform techniques of the present invention seek to represent the data in the form:

$$f_i = \sum_k c_k A_{ik} \tag{11}$$

in which $c_k$ are transform coefficients, and $A_{ik}$ are the transform bases. Likewise, the transform coefficients are computed as:

$$c_k = \frac{1}{\lambda_k}\sum_{i=0}^{N-1} f_i A_{ik} \tag{12}$$

Therefore, $c_k$ is determined directly from the building blocks obtained in the procedure described in connection with FIG. 5, or by first deriving the building blocks from a set of CA "gateway keys" or rule set parameters which are used to derive transform basis function A and its inverse B.

At step 608, the transform coefficients are quantized (preferably using a PsychoAcoustic model). For lossy encoding, the transform coefficients are quantized to discard negligible transform coefficients. In this approach the search is for a CA transform basis function that will maximize the number of negligible transform coefficients. The energy of the transform will be concentrated on a few of the retained transform coefficients.

Ideally, there will be a different set of values for the CA gateway keys for different parts of a data file. There is a threshold point at which the overhead involved in keeping track of different values for the CA gateway keys far exceeds the benefit gained in greater compression or encoding fidelity. In general, it is sufficient to "initialize" the encoding by searching for the one set of gateway keys with preferred overall properties: e.g., orthogonality, maximal number of negligible transform coefficients and predictable distribution of transform coefficients for optimal bit assignment. This approach is the one normally followed in most CA data compression schemes.

Continuing to step 610, the quantized transform coefficients are stored and/or transmitted. During storage/transmission, the quantized transform coefficients are preferably coded (step 612). In this regard, a coding scheme, such as embedded band-based threshold coding, bit packing, run length coding and/or special dual-coefficient Huffman coding is employed. Embedded band-based coding will be described in further detail below. The quantized transform coefficients form the compressed audio data that is transmitted/stored. If there are remaining audio samples, then the method returns to step 604 to read additional samples (step 614).

It should be appreciated that steps 608, 610 and 612 may be collectively referred to as the "quantizing" steps of the foregoing process, and may occur nearly simultaneously.

Figure 7:
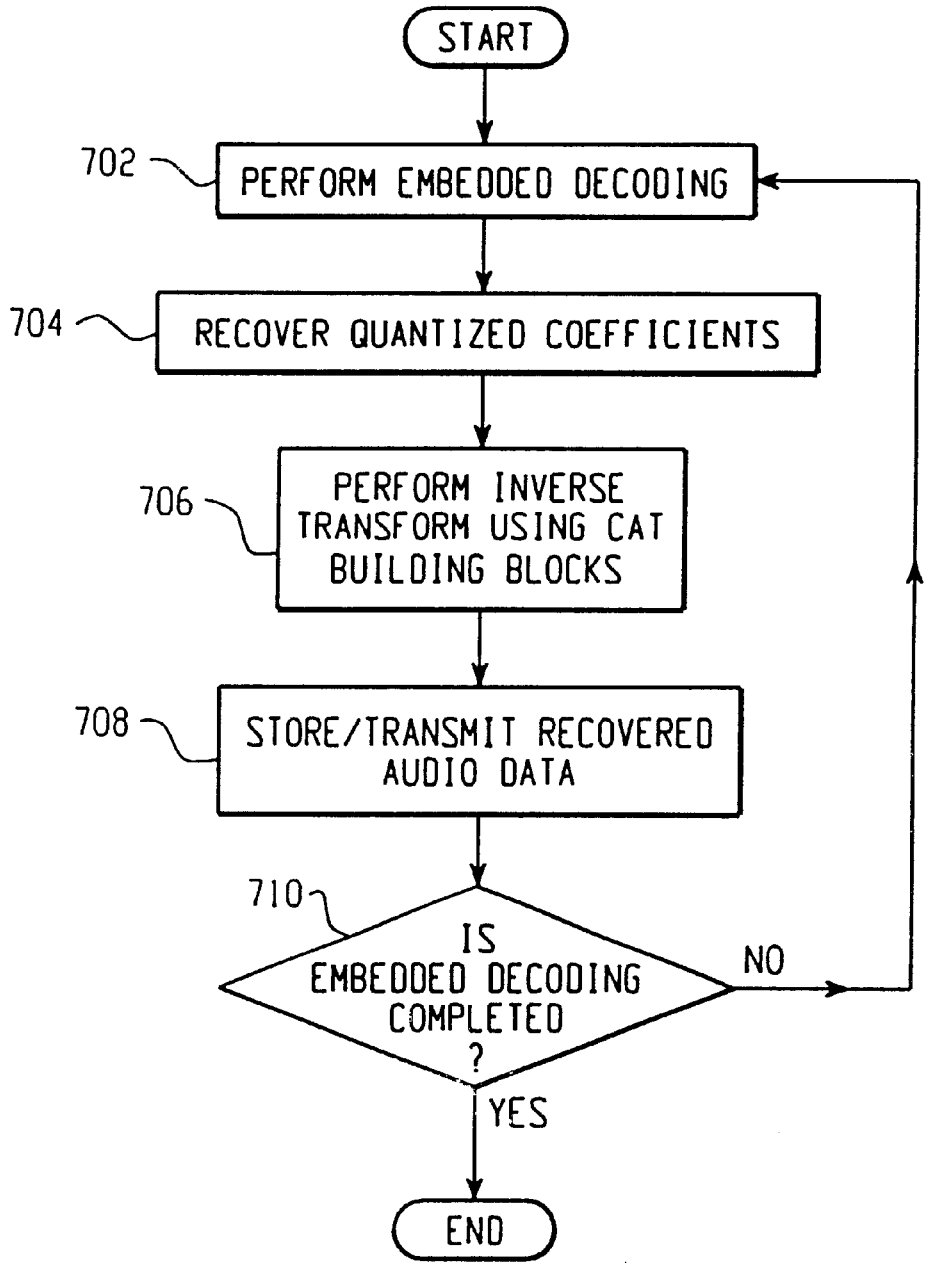
FIG. 7 is a flow diagram illustrating a decoding process, according to a preferred embodiment of the present invention.

The quantized transform coefficients are transmitted to a receiving system which has the appropriate building blocks, or has the appropriate information to derive the building blocks. Accordingly, the receiving device uses the transfer function and received quantized transform coefficients to recreate the original audio data. Referring now to FIG. 7, there is shown a summary of the process for decoding the compressed audio data. First, coded transform coefficients are decoded (step 702), e.g., in accordance with an embedded decoding process (step 702) to recover the original quantized transform coefficients (step 704). An inverse transform (equation 3) is performed using the appropriate transfer function basis and the quantized transform coefficients (step 706). Accordingly, the audio data is recovered and stored and/or transmitted (step 708). It should be appreciated that a "sub-band" inverse transform may be optionally performed at step 706, if a "sub-band" transform was performed during the encoding process described above. At step 710, it is determined whether embedded decoding is complete.

Figure 4:
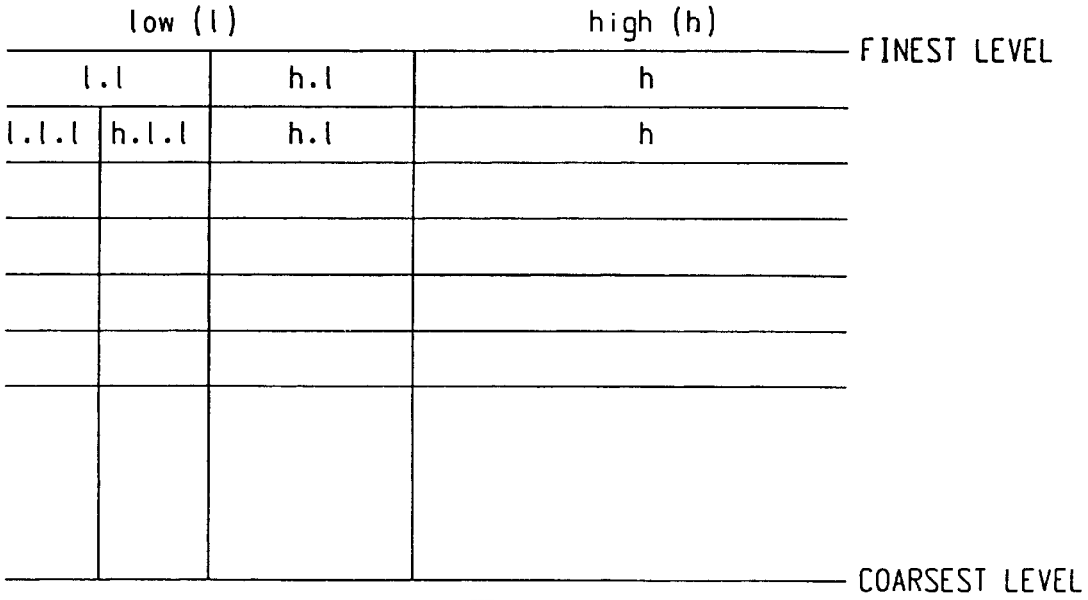
FIG. 4 illustrates a one-dimensional sub-band transform of a data sequence of length L.

Referring now to FIG. 4, one-dimensional sub-band coding will be described in detail. Sub-band coding is a characteristic of a large class of cellular automata transforms. Sub-band coding, which is also a feature of many existing transform techniques (e.g., wavelets), allows a signal to be decomposed into both low and high frequency components. It provides a tool for conducting the multi-resolution analysis of a data sequence.

For example, consider a one-dimensional data sequence, $f_i$, of length $L=2^n$, where n is an integer. This data is transformed by selecting M segments of the data at a time. The resulting transform coefficients are sorted into two groups, as illustrated in FIG. 4; those in the even location (which constitute the low frequencies in the data) fall into one group, and the odd points in the other. It should be appreciated that for some CAT transform basis functions the location of the low and high frequency components are reversed. In such cases the terms odd and even as used below, are interchanged. The "even" group is further transformed and the resulting $2^{n-1}$ transform coefficients is sorted into two groups of even and odd located values. The odd group is added to the odd group in the first stage; and the even group is again transformed. This process continues until the residual odd and even group is of size N/2. The N/2 transform coefficients belonging to the odd group is added to the set of all odd-located transform coefficients, while the last N/2 even-located group transform coefficients form the transform coefficients at the coarsest level. This last group is equivalent to the lowest CAT frequencies of the signal. At the end of this hierarchical process we actually end up with $L=2^n$ transform coefficients. Therefore, in FIG. 4, at the finest level the transform coefficients are grouped into two equal low (l) and high (h) frequencies. The low frequencies are further transformed and regrouped into high-low and low-low frequencies each of size L/4.

To recover the original data the process is reversed: we start from the N/2 low frequency transform coefficients and N/2 high frequency transform coefficients to form N transform coefficients; arrange this alternately in their even and odd locations; and the resulting N transform coefficients are reverse transformed. The resulting N transform coefficients form the even parts of the next 2 N transform coefficients while the transform coefficients stored in the odd group form the odd portion. This process is continued until the original L data points are recovered. For overlapping filters, the filter size N above should be replaced with $N_l=N-l$, where l is the overlap.

It should be appreciated that a large class of transform basis functions derived from the evolving field of cellular automata naturally possess the sub-band transform character. In some others the sub-band character is imposed by re-scaling the natural transform basis functions.

One of the immediate consequences of sub-band coding is the possibility of imposing a degree of smoothness on the associated transform basis functions. A sub-band coder segments the data into two parts: low and high frequencies. If an infinitely smooth function is transformed using a sub-band transform basis function, all the high frequency transform coefficients should vanish. In reality we can only obtain this condition up to a specified degree. For example, a polynomial function, $f(x)=x^n$, has an n-th order smoothness because it is differentiable n times. Therefore, for the transform bases $A_{ik}$ to be of n-order smoothness, we must demand that all the high frequency transform coefficients must vanish when the input data is up to an n-th order polynomial. That is, with $f(x)=f(i)=i^m$, we must have:

$$c_k = \sum_{i=0}^{N-1} i^m A_{ik} = 0 \tag{13}$$

k=1,3,5, . . . ; m=0,1,2, . . . n

In theory, the rules of evolution of the CA, and the initial configuration can be selected such that the above conditions are satisfied. In practice the above conditions can be obtained for a large class of CA rules by some smart re-scaling of the transform coefficients.

The following one-dimensional orthogonal non-overlapping transform basis functions have been generated from a 16-cell 32-state cellular automata. The filters are obtained using Type I Scheme II. The CA is evolved through 8 time steps. The properties are summarized in Table 1 set forth below.

Initial Configuration: 9 13 19 13 7 20 9 29 28 29 25 22 22 3 3 18

W-set coefficients: 0 13 27 19 26 25 17 5 14 1

TABLE 1

Non-overlapping CAT filters

| k → / i ↓ | 0 | 1 | 2 | 3 |
|---|---|---|---|---|
| 0 | 0.8282762765884399 | 0.5110409855842590 | 0.1938057541847229 | −0.1234294921159744 |
| 1 | 0.5476979017257690 | −0.7263893485069275 | −0.1903149634599686 | 0.3690064251422882 |
| 2 | −0.1181457936763763 | 0.1970712691545487 | 0.5122883319854736 | 0.8275054097175598 |
| 3 | −0.0051981918513775 | 0.4151608347892761 | −0.8147270679473877 | 0.4047644436359406 |

Multi-dimensional, non-overlapping filters are easy to obtain by using canonical products of the orthogonal one-dimensional filters. Such products are not automatically derivable in the case of overlapping filters.

While an image coder must put a greater priority on low frequencies than to high frequencies, an audio coder has to deal with the complexity of the human audio perception system. As far as CA-generated transform basis functions are concerned the non-overlapping filters tend to produce higher fidelity compressed audio signals than the overlapping filters. The transform coefficients are grouped into low and high frequencies. The CAT-based audio codec uses a sub-band thresholding method. Let $T_e$ be the threshold at which the coding terminates for each sub-band. Then the audio coding scheme follows these steps:

1. Determine $T_n$ the maximum transform coefficient in the n-th sub-band (n=0,1,2, . . . $n_R$−1) where $n_R$ is the number of sub-bands;
2. Perform Steps 3–5 for all the sub-bands for which $T_n>T_e$;
3. For each sub-band, set Threshold=$2^m>T_n$, where m is an integer;
4. Output m. This number is required by the decoder;
5. Perform Steps i, ii, and iii while Threshold>$T_e$
   i. For each of the sets of data belonging to low and high frequency, march from the coarsest sub-band to the finest. Determine $T_b$=maximum residual transform coefficient in each sub-band;
   ii. If $T_b$<Threshold encode YES and move onto the next sub-band;
   Otherwise encode NO and proceed to check each transform coefficient in the sub-band.
   a) If the transform coefficient value is less than Threshold encode YES;
   b) Otherwise encode POSV if transform coefficient is positive or NEGV if it is not.
   c) Decrease the magnitude of the transform coefficient by Threshold. This results in a new residual transform coefficient.
   iii. Set Threshold to Threshold/2.

The termination threshold, $T_e$, is derived from psychoacoustics models developed specifically for CAT-based audio filters. The model calculates the termination threshold as:

$$T_e = 2^{\frac{1}{n_R}\sum_{n=0}^{n_R-1}\omega_n \log_2(T_n)-Q} \tag{14}$$

where Q is an audio-fidelity parameter and w are weights whose distribution defines the importance of each sub-band. The simplest model is when the bands are given the same weight by setting ω=1 for all the sub-bands. For example, when $n_R$=8, Q=5, and using the simplest model we can encode and obtain a CD-Quality music compressed to between 12:1 and 25:1. Larger values of Q correspond to higher audio quality but reduced compression. The termination threshold is a measure of the error introduced in the coding process. Furthermore, the rate of decrement of the threshold would be a function of the band, instead of the constant 50% used above.

As the symbols YES, NO, POSV, NEGV are written, they are packed into a byte derived from a 5-letter base-3 word. The maximum value of the byte is 242, which is equivalent to a string of five NEGV. The above encoding schemes tend to produce long runs of zeros. The ensuing bytes can be encoded using any entropy method (e.g., Arithmetic Code, Huffman, Dictionary-based Codes). Otherwise the packed bytes can be run-length coded and then the ensuing data is further entropy encoded using a dual-coefficient Huffman Code. The examples shown below utilized the latter approach.

The non-overlapping, orthogonal, sub-band CAT filters shown in Table 2 have been evolved specifically for compressing audio data.

TABLE 2

Non-overlapping CAT filters

| k → / i ↓ | 0 | 1 | 2 | 3 |
|---|---|---|---|---|
| 0 | −0.8275159001350403 | −0.5122717618942261 | 0.1970276087522507 | 0.1182165592908859 |
| 1 | −0.2851759195327759 | 0.7287828922271729 | 0.6020380258560181 | 0.1584310680627823 |
| 2 | 0.1233587935566902 | −0.1938495337963104 | −0.5110578536987305 | −0.8282661437988281 |
| 3 | −0.4676266610622406 | 0.4109446406364441 | 0.5809907317161560 | −0.5243086814880371 |

Table 3 shows a summary of the CAT compression of the first 8 Mbytes of a "soft rock" music using the simplest model. The test section is a 16-bit, 44.1 kHz stereo music and it is divided into 463 segments ranging in length from 256 samples to 131072 samples. The segments are formed with the objective of grouping of samples of the same strength together.

TABLE 3

Fidelity/Compression/Threshold Profile

| Fidelity Parameter Q | Compression Ratio | Average Termination Threshold | Max. Termination Threshold |
|---|---|---|---|
| 2 | 98.4 | 2208 | 8192 |
| 3 | 45.1 | 1104 | 4096 |
| 4 | 22.4 | 552 | 2048 |
| 5 | 12.1 | 276 | 1024 |
| 6 | 7.3 | 138 | 512 |
| 7 | 4.8 | 69 | 256 |
| 8 | 3.4 | 35 | 128 |

Table 4 shows the influence of $n_R$ on the compression of the same music segment with Q=5.

TABLE 4

Effect of $n_R$ on Compressed File Size

| Number of Sub-bands, $n_R$ | File Size (Bytes) |
|---|---|
| 5 | 427,996 |
| 6 | 399,666 |
| 7 | 375,412 |
| 8 | 382,314 |
| 9 | 416,166 |

Figure 8:
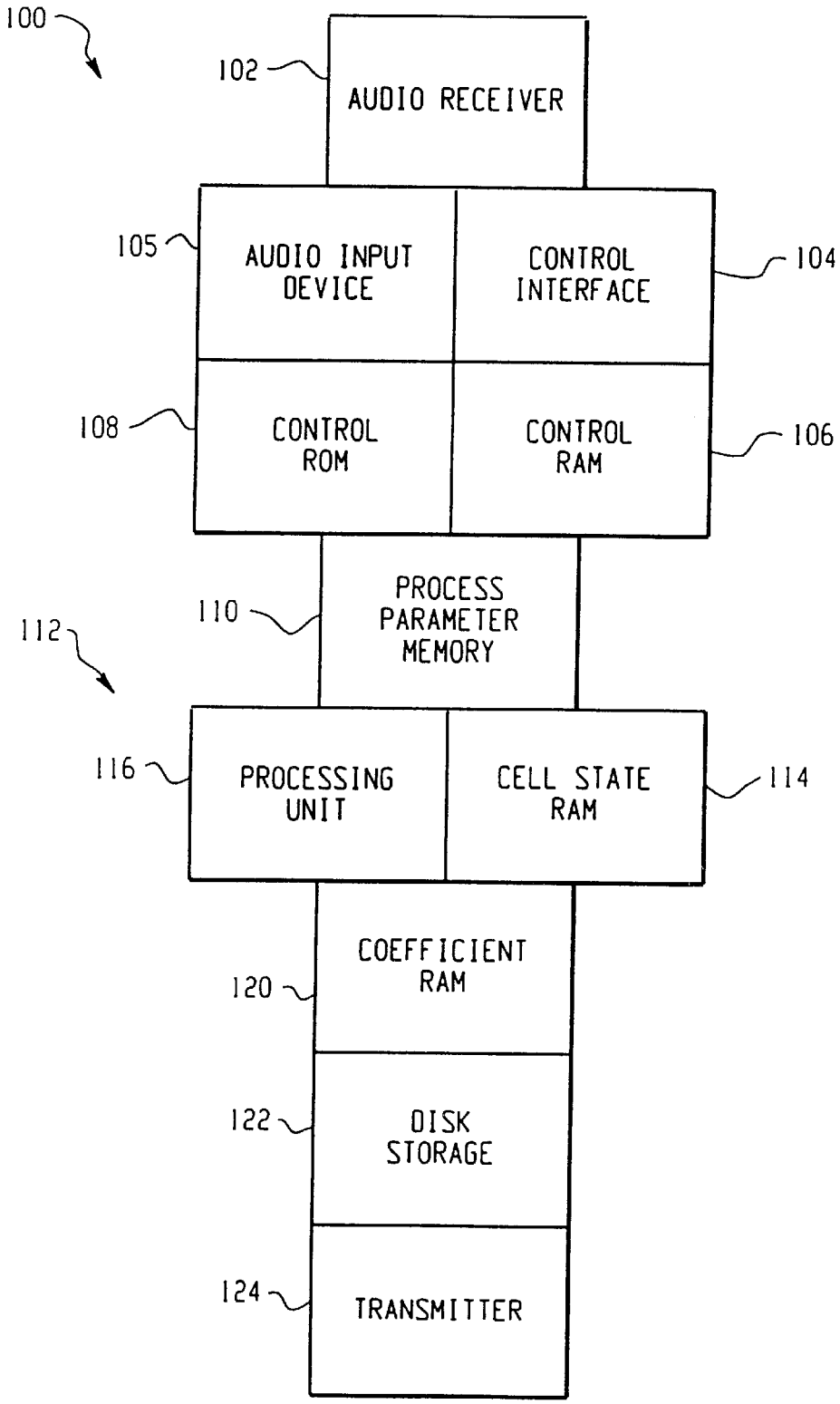
FIG. 8 is a block diagram of an exemplary apparatus for audio compression, in accordance with a preferred embodiment.

FIG. 8 is a block diagram of an apparatus 100, according to a preferred embodiment invention. It should be appreciated that other apparatus types, such as a general purpose computers, may be used to implement a dynamical system.

Apparatus 100 is comprised of an audio receiver 102, an audio input device 105, a programmed control interface 104, control read only memory ("ROM") 108, control random access memory ("RAM") 106, process parameter memory 110, processing unit (PU) 116, cell state RAM 114, coefficient RAM 120, disk storage 122, and transmitter 124. Receiver 102 receives image data from a transmitting data source for real-time (or batch) processing of information. Alternatively, image data awaiting processing by the present invention (e.g., archived images) are stored in disk storage 122.

The present invention performs information processing according to programmed control instructions stored in control ROM 108 and/or control RAM 106. Information processing steps that are not fully specified by instructions loaded into control ROM 108 may be dynamically specified by a user using an input device 105 such as a keyboard. In place of, or in order to supplement direct user control of programmed control instructions, a programmed control interface 104 provides a means to load additional instructions into control RAM 106. Process parameters received from input device 105 and programmed control interface 104 that are needed for the execution of the programmed control instructions are stored in process parameter memory 110. In addition, rule set parameters needed to evolve the dynamical system and any default process parameters can be preloaded into process parameter memory 110. Transmitter 124 provides a means to transmit the results of computations performed by apparatus 100 and process parameters used during computation.

The preferred apparatus 100 includes at least one module 112 comprising a processing unit (PU) 116 and a cell state RAM 114. Module 112 is a physical manifestation of the CA cell. In an alternate embodiment more than one cell state RAM may share a PU.

The apparatus 100 shown in FIG. 19 can be readily implemented in parallel processing computer architectures. In a parallel processing implementation, processing units and cell state RAM pairs, or clusters of processing units and cell state RAMs, are distributed to individual processors in a distributed memory multiprocessor parallel architecture.

The present invention discloses efficient means of compressing audio data by using building blocks derived from the evolving fields of cellular automata. The invention teaches a multiplicity of methods for obtaining the building blocks from the evolving dynamical system. The present invention also teaches a new approach for describing rules that govern a multi-state dynamical system via an "apparatus" that is a function of permutations of the cell states in neighborhoods of the system.

The present invention has been described with reference to a preferred embodiment. Obviously, modifications and alterations will occur to others upon a reading and understanding of this specification. It is intended that all such modifications and alterations be included insofar as they come within the scope of the appended claims or the equivalents thereof.

Having thus described the invention, it is now claimed:

1. A method of compressing audio data comprising:

determining a multi-state dynamical rule set and an associated transform basis function, of a dynamical system;

receiving input audio data; and performing a forward transform using the transform basis function to obtain transform coefficients suitable for reconstructing the input audio data, wherein the rule of evolution of the dynamical system, having a neighborhood of m cells and a radius r, is defined by using a vector of integers $W_j$ (j=0,1,2,3, . .

. , $2^m$) such that the state of cell $$a_{(r)(t+1)} = \left( \sum_{j=0}^{2^m-2} W_j \alpha_j + W_{2^m-1} \right)^{W_{2^m}} \bmod K$$

where $0 \leqq W_j < K$, and $\alpha_j$ are permutations and products of states of the m cells in the neighborhood.

2. A method according to claim 1, wherein said step of determining the dynamical rule set includes selecting W-set coefficients.

3. A method according to claim 1, wherein said step of determining the dynamical rule set includes selecting for the dynamical system at least one of: lattice size N, a neighborhood size m, a maximum state K, and boundary conditions BC.

4. A method according to claim 1, wherein said method further comprises quantizing said transform coefficients.

5. A method according to claim 4, wherein said step of quantizing uses a psycho-acoustic model.

6. A method according to claim 1, wherein said step method further comprises encoding said transform coefficients in accordance with at least one of: embedded band-based threshold coding, bit packing, run length coding, and special dual-coefficient Huffman coding.

7. A method according to claim 1, wherein said transform coefficients are quantized in accordance with a psycho-acoustic model.

8. A method according to claim 1, wherein said method further comprises the step of transmitting said transform coefficients.

9. A method according to claim 1, wherein said method further comprises the step of storing said transform coefficients.

10. A method according to claim 1, wherein said step of performing a forward transform includes applying said transform basis function to said input audio data in an overlapping manner.

11. A method according to claim 1, wherein said step of performing a forward transform includes applying said transform basis function to said input audio data in a nonoverlapping manner.

12. A method according to claim 1, wherein said multi-state dynamical system is cellular automata.

13. A method according to claim 1, wherein said method further comprises:

receiving said transform coefficients; and performing an inverse transform using said transform basis function to reconstruct said input audio data.

14. A method according to claim 13, wherein said method further comprises:

decoding said transform coefficients in accordance with at least one of: embedded band-based threshold decoding, bit packing, run length decoding, and special dual-coefficient Huffman decoding, prior to performing said inverse transform.

15. A method according to claim 13, wherein said step of performing said inverse transform includes performing a sub-band inverse transform.

16. A method according to claim 13, wherein said method further comprises at least one of:

storing and transmitting said reconstructed input audio data.

17. A method according to claim 13, wherein said step of performing said inverse transform includes applying said transform basis function in an overlapping manner.

18. A method according to claim 13, wherein said step of performing said inverse transform includes applying said transform basis function in a non-overlapping manner.

19. An apparatus for compressing audio data comprising:

means for determining a multi-state dynamical rule set and an associated transform basis function of a dynamical system;

means for receiving input audio data; and means for performing a forward transform using the transform basis function to obtain transform coefficients suitable for reconstructing the input audio data, wherein the rule of evolution of the dynamical system, having a neighborhood of m cells and a radius r, is defined by using a vector of integers $W_j$ (j=0,1,2,3, . . . ,$2^m$) such that the state of cell $$a_{(r)(t+1)} = \left( \sum_{j=0}^{2^m-2} W_j \alpha_j + W_{2^m-1} \right)^{W_{2^m}} \bmod K$$

where $0 \leqq W_j < K$, and $\alpha_j$ are permutations and products of states of the m cells in the neighborhood.

20. An apparatus according to claim 19, wherein said means for determining the dynamical rule set includes means for selecting W-set coefficients.

21. An apparatus according to claim 19, wherein said means for determining the dynamical rule set includes means for selecting for the dynamical system at least one of: lattice size N, a neighborhood size m, a maximum state K, and boundary conditions BC.

22. An apparatus according to claim 19, wherein said apparatus further comprises means for quantizing said transform coefficients.

23. An apparatus according to claim 22, wherein said means for quantizing uses a psycho-acoustic model.

24. An apparatus according to claim 19, wherein said apparatus further comprises means for encoding said transform coefficients in accordance with at least one of: embedded band-based threshold coding, bit packing, run length coding, and special dual-coefficient Huffman coding.

25. An apparatus according to claim 19, wherein said transform coefficients are quantized in accordance with a psycho-acoustic model.

26. An apparatus according to claim 19, wherein said apparatus further comprises means for transmitting said transform coefficients.

27. An apparatus according to claim 19, wherein said apparatus further comprises means for storing said transform coefficients.

28. An apparatus according to claim 19, wherein said means for performing a forward transform includes means for applying said transform basis function to said input audio data in an overlapping manner.

29. An apparatus according to claim 19, wherein said means for performing a forward transform includes means for applying said transform basis function to said input audio data in a nonoverlapping manner.

30. An apparatus according to claim 19, wherein said multi-state dynamical system is cellular automata.

31. An apparatus according to claim 19, wherein said apparatus further comprises:

means for receiving said transform coefficients; and means for performing an inverse transform using said transform basis function to reconstruct said input audio data.

32. An apparatus according to claim 31, wherein said apparatus further comprises:

means for decoding said transform coefficients in accordance with at least one of: embedded band-based threshold decoding, bit packing, run length decoding, and special dual-coefficient Huffman decoding.

33. An apparatus according to claim 31, wherein said means for performing said inverse transform includes means for performing a sub-band inverse transform.

34. An apparatus according to claim 31, wherein said apparatus further comprises at least one of:

means for storing the reconstructed input audio data, and means for transmitting said reconstructed input audio data.

35. An apparatus according to claim 31, wherein said means for performing said inverse transform includes means for applying said transform basis function in an overlapping manner.

36. An apparatus according to claim 31, wherein said means for performing said inverse transform includes means for applying said transform basis function in a nonoverlapping manner.

37. A method of embedded band-based threshold coding for sub-band encoded transform coefficients, comprising:

determining a maximum transform coefficient in the n-th sub-band ($T_n$), where n=0, 1, 2, . . . $n_R$, $n_R$ being the number of sub-bands;

performing steps (a), (b) and (c) for all sub-bands for which $T_n > T_e$, wherein $T_e$ is a threshold at which coding terminates for each sub-band:

(a) setting a Threshold=$2^m > T_n$, where m is an integer, and performing steps (1), (2), and (3) while Threshold>$T_e$ (1) marching from the coarsest sub-band to the finest sub-band for each of the sets of data belonging to low and high frequencies, and determining the maximum residual transform coefficient ($T_h$) in each sub-band;

(2) if $T_h$<Threshold encoding YES and moving onto the next sub-band, otherwise encoding NO and proceeding to check each transform coefficient in the sub-band, wherein (A) if the transform coefficient value is less than Threshold encoding YES, otherwise encoding POSV if transform coefficient is positive or NEGV if it is not, and (B) decreasing the magnitude of the transform coefficient by Threshold; and (3) setting Threshold to Threshold/2.

38. A method according to claim 37, wherein said termination threshold $T_e$, is derived from a psycho-acoustic model.

39. A method according to claim 38, wherein the psycho-acoustic model determines threshold said termination threshold $T_e$ in accordance with:

$$T_e = 2^{\frac{1}{n_R}\sum_{n=0}^{n_R-1}\omega_n \log_2(T_n)-Q}$$

where Q is an audio-fidelity parameter and ω are weights whose distribution defines the importance of each sub-band.

* * * * *